US006547622B2

(12) United States Patent
Thai

(10) Patent No.: US 6,547,622 B2
(45) Date of Patent: Apr. 15, 2003

(54) BUBBLE GENERATING ASSEMBLIES

(75) Inventor: Douglas Thai, Walnut, CA (US)

(73) Assignee: Arko Development Limited (VG)

( * ) Notice: Subject to any disclaimer, the term of this patent is extended or adjusted under 35 U.S.C. 154(b) by 0 days.

(21) Appl. No.: 09/862,746

(22) Filed: May 22, 2001

(65) Prior Publication Data

US 2002/0031977 A1 Mar. 14, 2002

Related U.S. Application Data

(63) Continuation-in-part of application No. 09/476,864, filed on Jan. 3, 2000.

(51) Int. Cl.[7] ..... A63H 33/28
(52) U.S. Cl. ..... 446/15; 446/16; 446/18
(58) Field of Search ..... 446/15–21

(56) References Cited

U.S. PATENT DOCUMENTS

| | | | | | |
|---|---|---|---|---|---|
| 2,560,582 | A | | 7/1951 | Limber | |
| 2,587,537 | A | * | 2/1952 | Scott | 446/15 |
| 2,606,396 | A | * | 8/1952 | Hill | 239/355 |
| 2,659,177 | A | | 11/1953 | Kopf | |
| 2,700,845 | A | | 2/1955 | Arliss | |
| 3,100,947 | A | | 8/1963 | Hellman | |
| 3,109,255 | A | * | 11/1963 | Hein | 446/15 |
| 3,845,583 | A | * | 11/1974 | Ziff | 446/17 |
| 4,775,348 | A | * | 10/1988 | Collins | 446/15 |
| RE32,973 | E | * | 7/1989 | Panzarella | 446/16 |
| 5,234,129 | A | | 8/1993 | Lau | |
| 5,462,469 | A | | 10/1995 | Lei | |
| 5,498,191 | A | | 3/1996 | DeMars | |
| 5,613,890 | A | | 3/1997 | DeMars | |

* cited by examiner

*Primary Examiner*—Derris H. Banks
*Assistant Examiner*—Bena B. Miller
(74) *Attorney, Agent, or Firm*—Raymond Sun

(57) ABSTRACT

A bubble generating assembly has a housing, an air generator associated with the housing, a bubble producing device positioned in front of the air generator to receive air generated from the air generator, and a cover or dipping cup configured as an inverted cup. The cover or dipping cup has an interior and a locking mechanism that removably connects the housing, and the cover or dipping cup retains the bubble producing device in the interior when the cover or dipping cup is connected to the housing. In addition, a bubble generating device has a loop with a cylindrical wall extending from the opening of the loop. The cylindrical wall has a plurality of ridges provided on the inner circumferential surface thereof.

19 Claims, 7 Drawing Sheets

BUBBLE GENERATING ASSEMBLIES

RELATED CASES

This is a continuation-in-part of Ser. No. 09/476,864, entitled "Bubble Generating Assemblies", filed Jan. 3, 2000, whose disclosures are incorporated by this reference as though fully set forth herein.

BACKGROUND OF THE INVENTION

1. Field of the Invention

The present invention relates to bubble generating assemblies, and in particular, to bubble generating assemblies which include a cap that covers the bubble generating device and also functions as a dipping cup.

2. Description of the Prior Art

Bubble producing toys are very popular among children who enjoy producing bubbles of different shapes and sizes. Many bubble producing toys have previously been provided. Perhaps the simplest example has a stick with a circular opening or port at one end, resembling a wand. A film is produced when the port is dipped into a bubble solution or bubble producing fluid (such as soap) and then removed therefrom. Bubbles are then formed by blowing carefully against the film. Such a toy requires dipping every time a bubble is to created, and the bubble solution must accompany the wand from one location to another. Another drawback is that only one bubble can be produced at a time. Therefore, such simple bubble producing toys offer limited amusement and are limited in the types, shapes and sizes of the bubbles that they can produce.

As a result, attempts have been made to provide bubble producing toys that offer more variety and amusement. Many of these newer bubble producing toys are more sophisticated, and many even allow for the provision of multiple bubbles.

Notwithstanding the above, there remains a need to provide bubble producing toys that can further enhance the amusement value and play variety for children.

SUMMARY OF THE DISCLOSURE

It is an object of the present invention to provide a bubble generating toy that enhances the amusement value and play variety for children.

It is another object of the present invention to provide a bubble generating toy that includes a cap that covers the bubble generating device.

It is yet another object of the present invention to provide a bubble generating toy that includes a cap that also functions as a dipping cup for receiving the bubble generating device during use.

It is yet another object of the present invention to provide a bubble generating device that produces better bubbles, and a larger number of bubbles.

The objectives of the present invention are accomplished by providing a bubble generating assembly that has a housing, an air generator associated with the housing, a bubble producing device positioned in front of the air generator to receive air generated from the air generator, and a cover or dipping cup configured as an inverted cup. The cover or dipping cup has an interior and a locking mechanism that removably connects the housing, and the cover or dipping cup retains the bubble producing device in the interior when the cover or dipping cup is connected to the housing.

The present invention also provides a bubble generating device that has a loop with a cylindrical wall extending from the opening of the loop. The cylindrical wall has a plurality of ridges provided on the inner circumferential surface thereof. The cylindrical wall and the ridges positioned on the inner circumferential surface of the cylindrical wall further enhance bubble production.

DETAILED DESCRIPTION OF THE PREFERRED EMBODIMENTS

Figure 1:
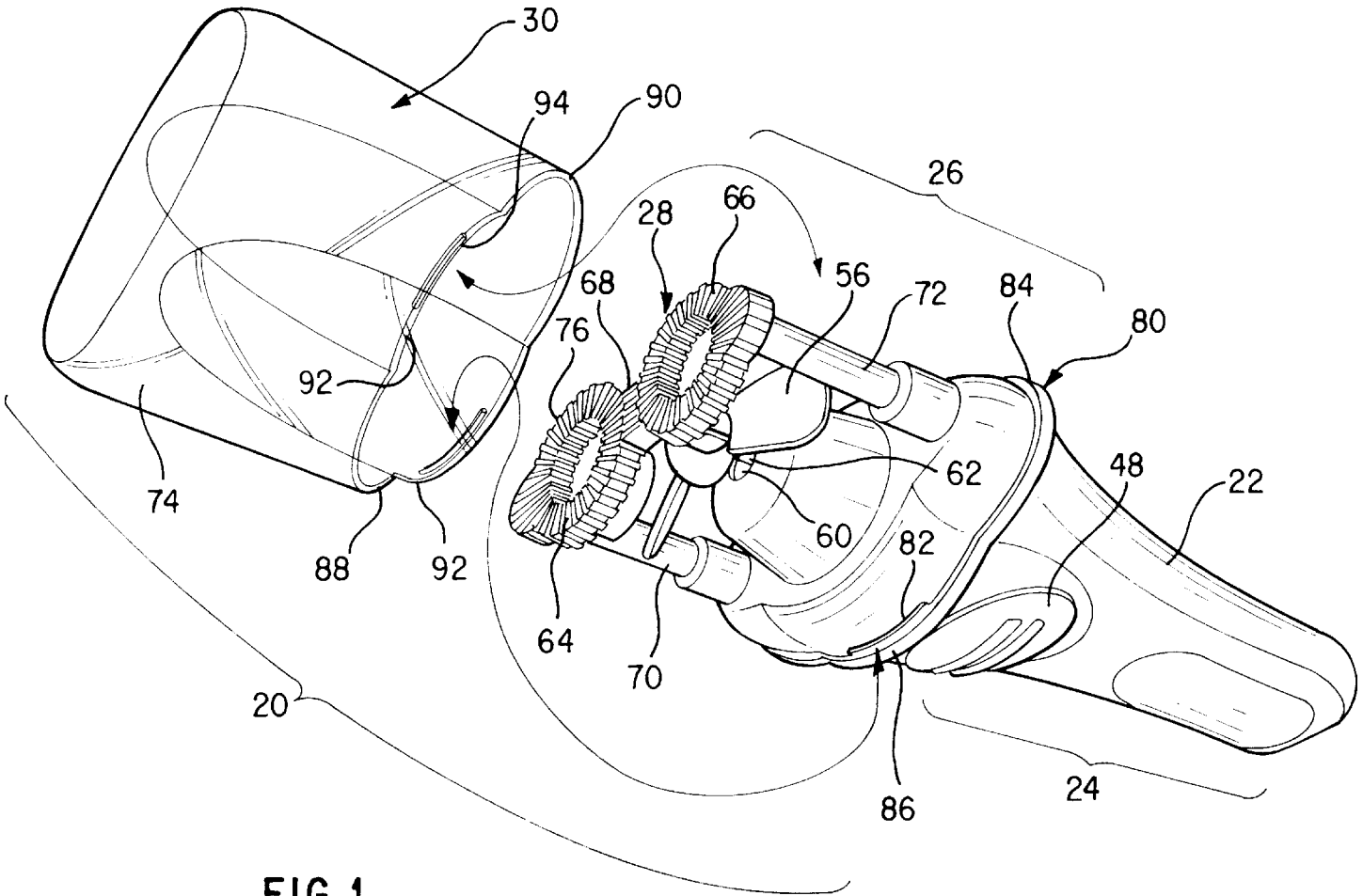
FIG. 1 is an exploded perspective view of a bubble generating assembly according to one embodiment of the present invention.
Figure 3:
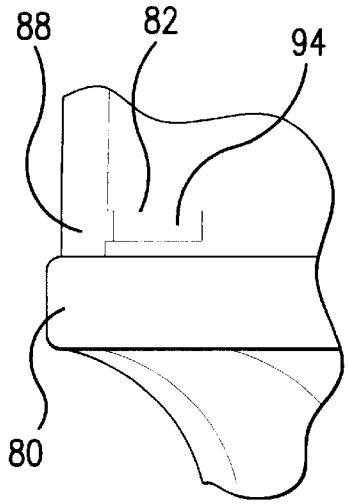
FIG. 3 is an enlarged sectional view of the region labeled 3 in FIG. 2.
Figure 2:
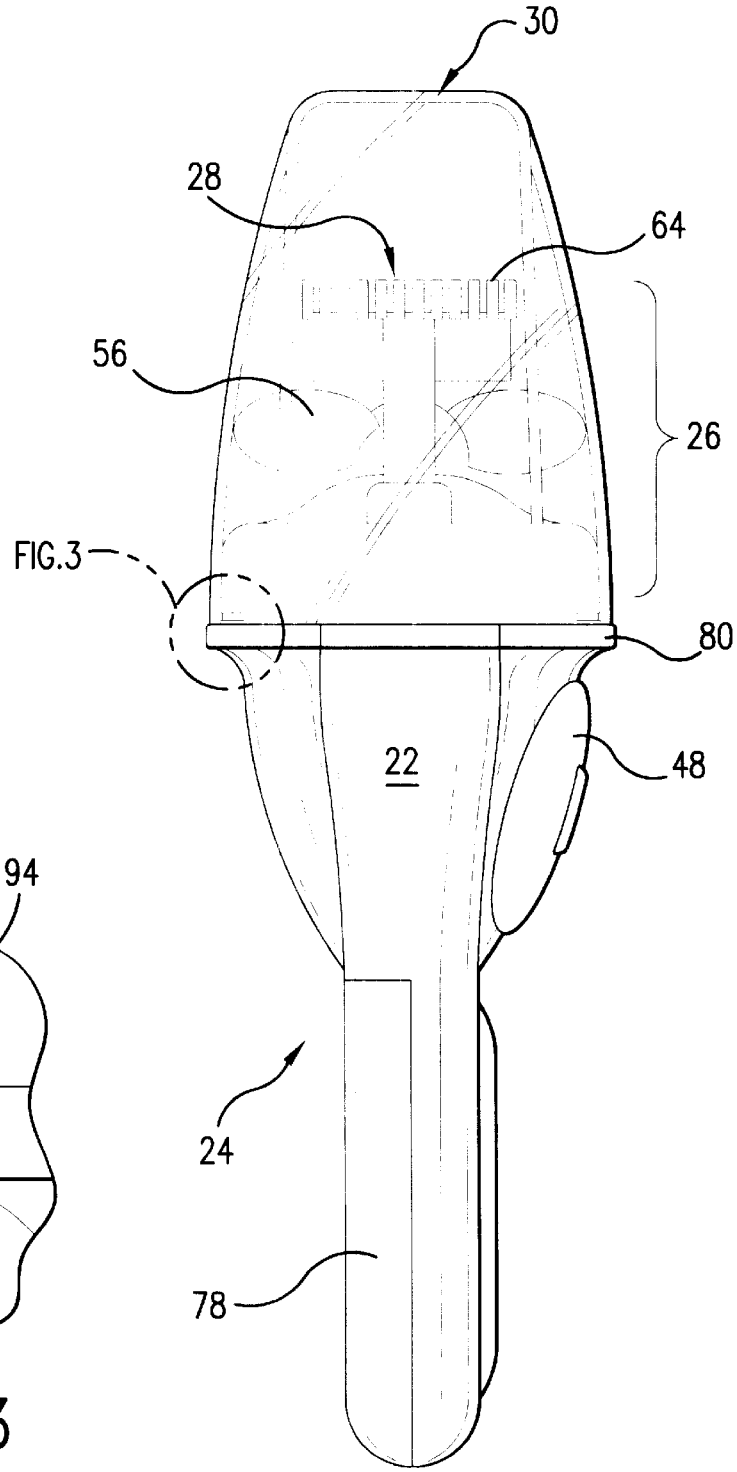
FIG. 2 is a side plan view of the bubble generating assembly of FIG. 1.
Figure 4:
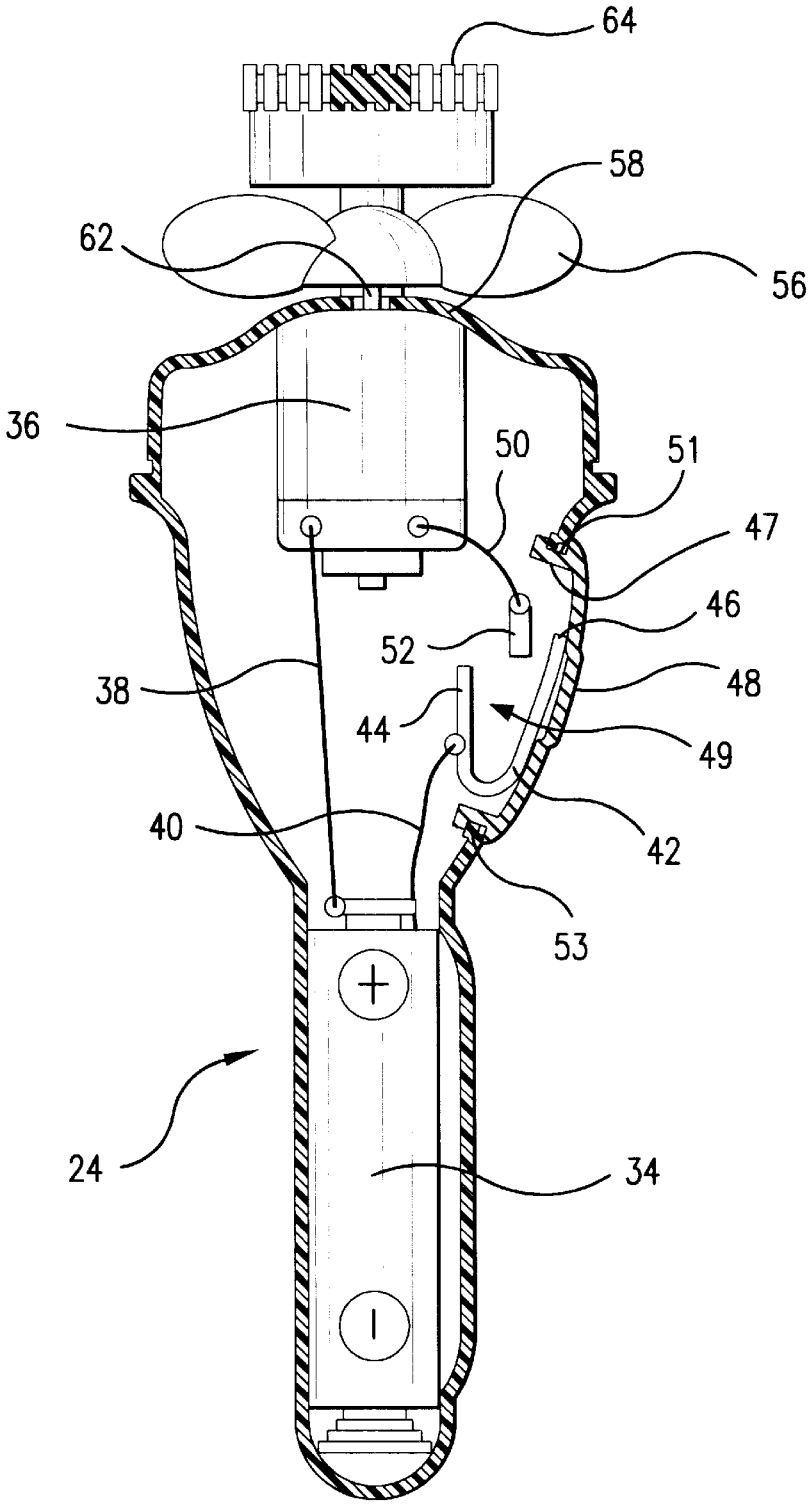
FIG. 4 is a cross-sectional side view of the bubble generating assembly of FIG. 1.
Figure 8:
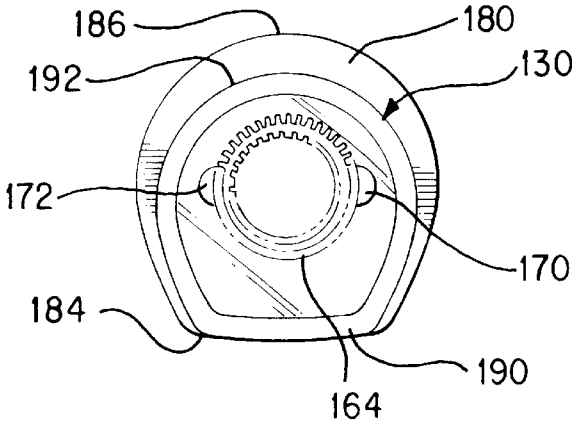
FIG. 8 is a top plan view of the bubble generating assembly of FIG. 5.
Figure 5:
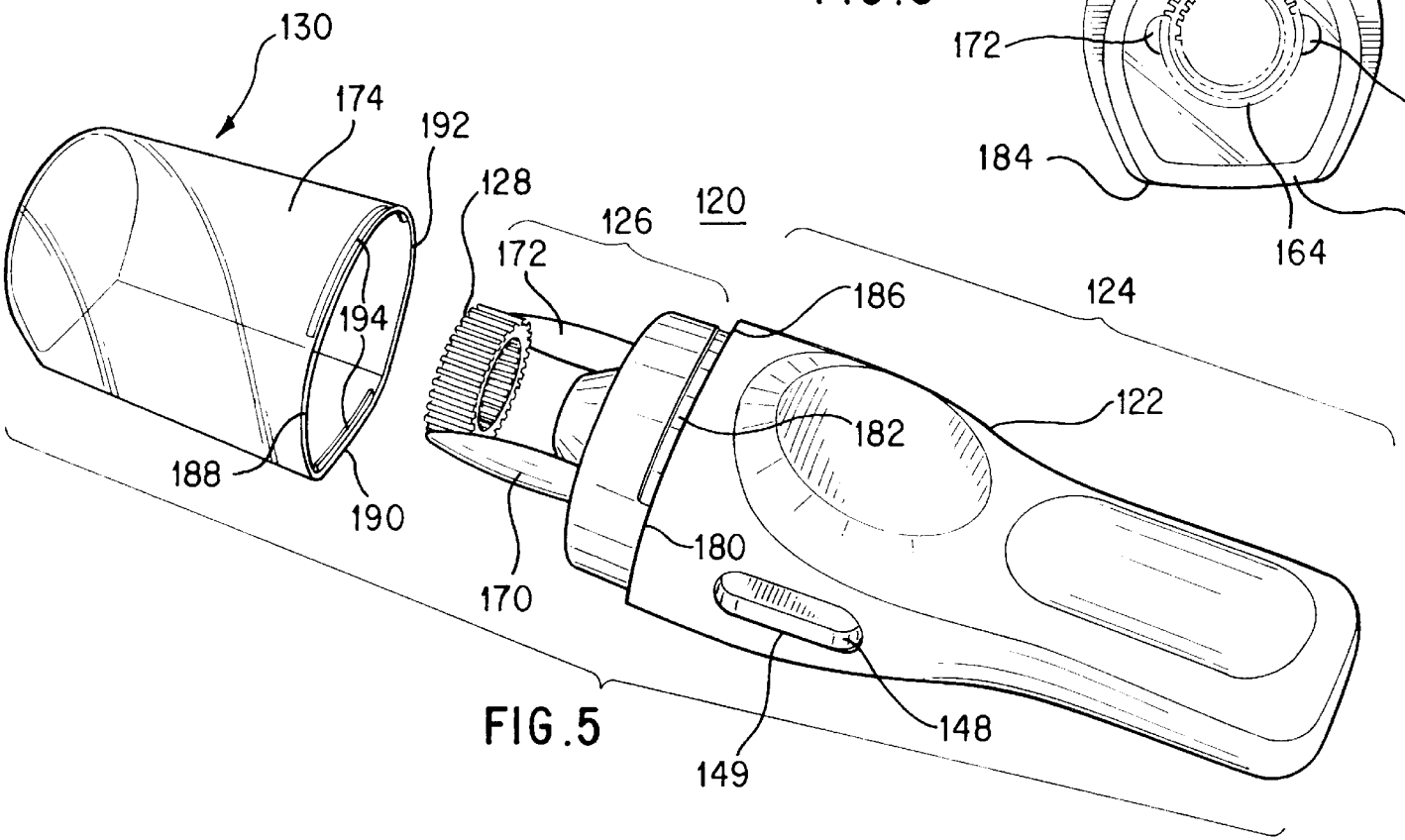
FIG. 5 is an exploded perspective view of a bubble generating assembly according to another embodiment of the present invention.
Figure 7:
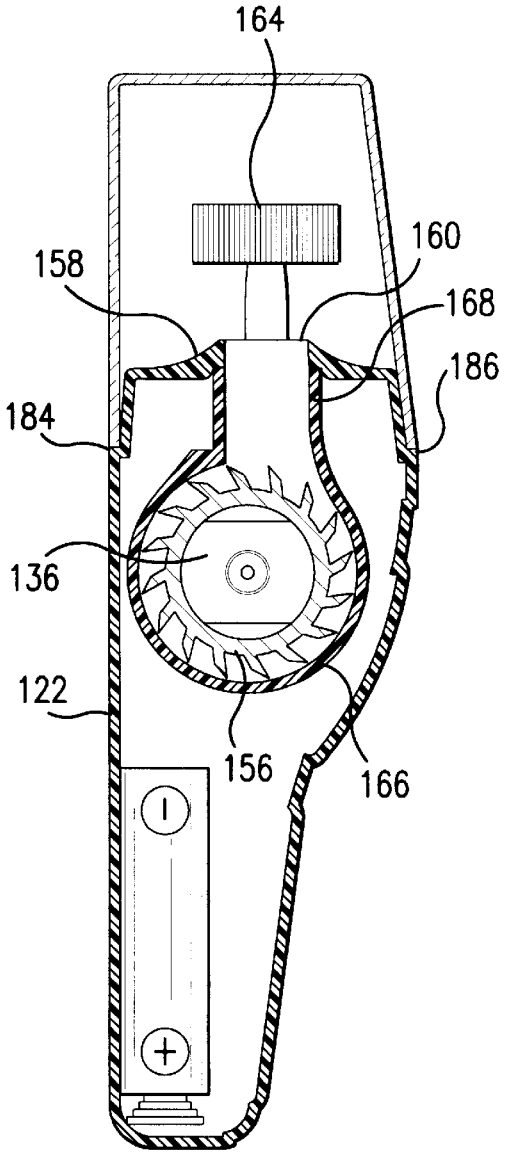
FIG. 7 is a cross-sectional side view of the bubble generating assembly of FIG. 5.
Figure 6:
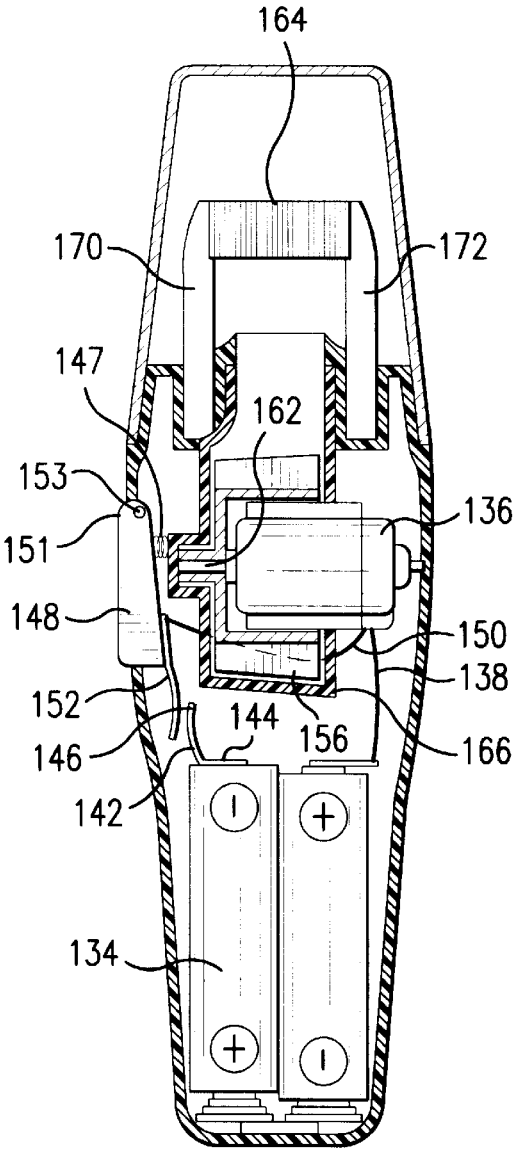
FIG. 6 is a cross-sectional front view of the bubble generating assembly of FIG. 5.

The following detailed description is of the best presently contemplated modes of carrying out the invention. This description is not to be taken in a limiting sense, but is made merely for the purpose of illustrating general principles of embodiments of the invention. The scope of the invention is best defined by the appended claims. In certain instances, detailed descriptions of well-known devices and mechanisms are omitted so as to not obscure the description of the present invention with unnecessary detail.

The present invention provides bubble generating assemblies that provide a cap to cover and protect the bubble generating device of the bubble generating assembly. The cap can be used as a dipping cup for receiving the bubble generating device, yet can be secured to the bubble generating assembly to provide a single unit that does not become detached easily. The cap is provided with a locking mechanism to secure the cap to the bubble generating assembly. As a result, the cap is not so easily detached, which minimizes the possibility of the cap being lost.

FIGS. 1–4 illustrate a bubble generating assembly 20 according to one embodiment of the present invention. The assembly 20 has a housing 22 that includes a handle section 24 and a bubble generating section 26. A bubble producing device 28 is provided at the bubble generating section 26, and a dipping cup or cap 30 can be inserted over the bubble producing device 28 and secured to the housing 22.

Although the term "dipping cup" will be used hereinafter to describe elements 30 and 130, this term is used arbitrarily, and this does not diminish the ability of elements 30 and 130 to function as a cover.

The housing 22 can be provided in the form of two symmetrical outer shells that are connected together by, for example, screws or welding or glue. These outer shells together define a hollow interior for housing the internal components of the assembly 20, as described below.

The handle section 24 houses a power source 34 which can include at least one conventional battery. The upper portion of the housing 22 (adjacent the bubble generating section 26) houses a motor 36 that is electrically coupled to the power source 34 via a first wire 38. A second wire 40 couples the power source 34 to a first end 44 of a first electrical contact 42, whose other end 46 is attached to a switch plate 48 that extends outside the housing 22. The first electrical contact 42 is generally curved, and also functions as a biasing element to normally bias the switch plate 48 outwardly. A third wire 50 couples the motor 36 to a second electrical contact 52 that is normally positioned spaced apart from a second end 46 of the first electrical contact 42.

The switch plate 48 is seated over a generally circular opening 49 in the housing 22, and has at least one side wall 47 that has a groove 51 defined in the side wall 47. The groove 51 retains an edge 53 of the opening 49 in a manner so that the edge 53 can be reciprocated within the groove 51 when the switch plate 48 is pressed and released by the user. By retaining the edge 53 in reciprocating fashion inside the groove 51, the switch plate 48 cannot be removed from the opening 49, yet portions of the side wall 47 can be moved into and out of the opening 49.

An air generator 56 is rotationally coupled to a shaft 62 on the motor 36, with the shaft 62 of the motor 36 extending through an opening 60 at the top 58 of the housing 22, so that the air generator 56 is actually positioned outside the housing 22 at the top thereof. The air generator 56 can be a fan having a plurality of blades. Thus, when the user presses on the switch plate 48, the end 46 of the electrical contact 42 contacts the electrical contact 52 to electrically couple the power source 34 and the motor 36, thereby actuating the motor 36 which in turn causes the air generator 56 to rotate to generate a stream of air. When the user releases the switch plate 48, the first electrical contact 42 biases the switch plate 48 outwardly away from the housing 22, to uncouple the engagement between the electrical contacts 42 and 52.

The bubble producing device 28 has at least one wand that is supported over the air generator 56 so that the air generated from the air generator 56 is directed at the at least one wand. In the embodiment illustrated in FIGS. 1–4, the bubble producing device 28 has two separate wands 64 and 66 that are connected together by a bridge 68. Two shafts 70 and 72 extend from the housing 22 along each side of the location of the air generator 56, and each shaft 70 and 72 connects with a separate wand 64 and 66, respectively. In this manner, the air generator 56 is positioned between the shafts 70, 72 and below the wands 64, 66.

Figure 9:
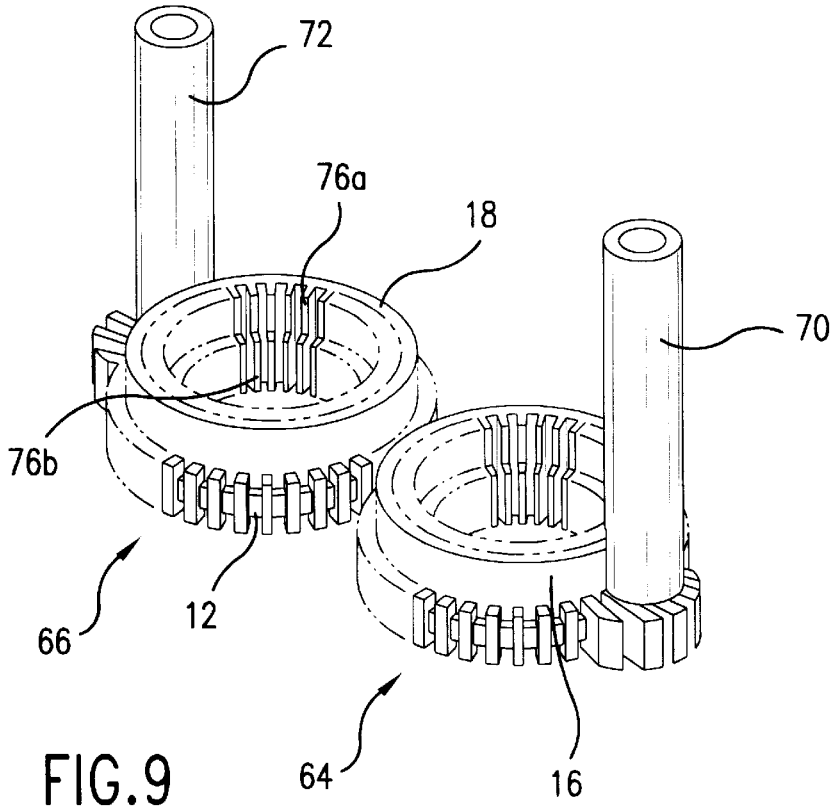
FIG. 9 is a bottom perspective view of a bubble producing device that can be used with the bubble generating assemblies of the present invention.
Figure 10:
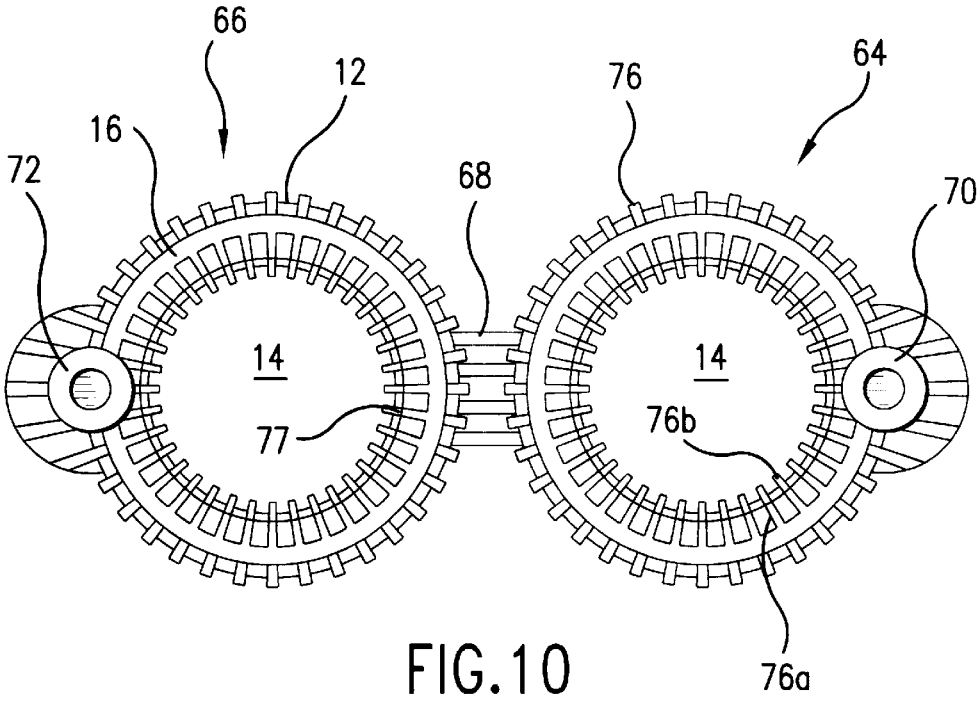
FIG. 10 is a bottom plan view of the bubble producing device of FIG. 9.

Although FIGS. 1–4 illustrate the provision of two wands 64, 66, it is possible to provide the bubble producing device 28 with any number of wands. Referring also to FIGS. 9 and 10, each wand 64, 66 can have the same structure, and in one non-limiting embodiment, can be a ring-like loop 12 that has an opening 14. A cylindrical wall 16 extends vertically downwardly from the loop 12 to form a tube-like extension. Each cylindrical wall 16 defines a channel that allows air generated from the bottom of the wand 64, 66 to enter the channel from the bottom edge 18 of the corresponding cylindrical wall 16. Thus, each channel functions to direct a collected mass of air towards the loop 12. It has been found that such a collected mass of air enhances the formation of bubbles.

Ridges or bumps 76 can be provided on some or all of the surfaces of the loops 12. For example, the ridges 76 can be provided on the top surface, the bottom surface, the outer circumferential surface, or the inner circumferential surface of the wands 64, 66. The ridges 76 function to hold the bubble solution against the ring to form a solution film that is blown to form the bubble. By providing the ridges 76 on the top surface, the bottom surface, the outer circumferential surface, and the inner circumferential surface (i.e., most or all surfaces) of the wands 64, 66, the bubble producing effect of the wands 64, 66 can be further enhanced. In addition, these ridges 76 can also be provided on the inner circumferential surface of the cylindrical wall 16. For example, a first layer 76*a* of ridges 76 can be provided on the inner circumferential surface of the cylindrical wall 16 adjacent the bottom edge 18. A second layer 76*b* of ridges 76 can also be provided on the inner circumferential surface of the cylindrical wall 16 between the loop 12 and the first layer 76*a*, with the ridges 76 in the second layer 76*b* being thicker than (i.e., having a greater height than) the ridges 76 in the first layer 76*a*. In other words, a step 77 is formed between the first and second layers 76*a* and 76*b* of ridges, transitioning from a channel that has a greater diameter at the first layer 76*a* to a channel that has a smaller diameter at the second layer 76*b*. Thus, by providing ridges 76 on the inner circumferential surface of the cylindrical wall 16, the present invention enhances the production of more complete bubbles, and a greater number of bubbles. Tests have shown that this enhancement can be further improved by providing this step 77 between two adjacent layers 76*a*, 76*b* of ridges 76 that have varying diameters.

The housing 22 can be provided with an opening through which the power source 34 can be inserted and removed. A battery cover 78 can be provided to fit securely in the opening to cover and protect the power source 34.

The dipping cup 30 has a cup body 74 that is configured to accomplish three purposes: (1) to allow the wands 64, 66 to be conveniently and easily fitted inside the dipping cup 30, (2) to secure the dipping cup 30 to the housing 22, and (3) to contain or hold bubble solution that can be accessed by the wands 64, 66. As a result, the dipping cup 30 has a configuration that resembles the overall outer profile of the wands 64, 66, and of the bubble generating section 26 of the housing 22. In particular, the housing 22 has a flange 80 that extends radially outwardly, and has a pair of grooves 82 positioned adjacent the flange 80 on opposing sides thereof. The flange 80 has two opposing curved narrowed sides 84, and two opposing curved widened sides 86. Although the grooves 82 are shown as being adjacent the widened sides 86, the grooves 82 can be provided along any of the sides 84 or 86. Similarly, the top edge 88 of the dipping cup 30 has a configuration that corresponds with the configuration of the flange 80, with two opposing curved narrowed sides 90, and two opposing curved widened sides 92. The curved widened sides 92 allow for the curved wands 64, 66 to be easily fitted into the interior of the dipping cup 30. A protrusion 94 extends inwardly from each widened side 92 of the top edge 88 of the dipping cup 30, and is adapted to engage a corresponding groove 82 to provide a snap-fit locking engagement that secures the dipping cup 30 to the housing 22. Although the protrusions 94 and grooves 82 are illustrated as the locking mechanism, it is also possible to utilize other similar locking mechanisms, such as but not limited to hook and fastener connections, screw connections and tabs, among others, between the body 74 of the dipping cup 30 and the housing 22.

The operation of the assembly 20 is illustrated in connection with FIGS. 1–4. First, the assembly 20 is provided in one piece with the dipping cup 30 secured to the housing 22. To use the assembly 20, the user removes the dipping cup 30 from the housing 22 simply by pulling the dipping cup 30 out of its snap-fit engagement with the housing 22. The user then pours bubble solution into the dipping cup 30, and while gripping the handle section 24, extends the wands 64, 66 into the dipping cup 30 to contact the bubble solution. The user removes the wands 64, 66 from the dipping cup 30, and at this time, a thin film of bubble solution should extend over the opening 14 of each wand 64, 66. The ridges 76 further facilitate the consistent distribution of the film of bubble solution about the entire loop 12 to further maximize the possibility of producing better quality bubbles. In the next step, the user presses the switch plate 48 to cause the contacts 42 and 52 to engage each other, thereby completing the electrical circuit and causing the motor 36 to be powered to rotate the air generator 56 to generate bursts of air that are directed at the wands 64, 66. The air that is blown from the air generator 56 will pass through the wands 64, 66 to produce a plurality of bubbles. The ridges 76 will also assist in producing a larger number of bubbles. The user can repeat this process to produce more bubbles. When the user has completed his or her use of the assembly 20, the user can empty the bubble solution from the dipping cup 30, and snap-fit the protrusions 94 of the dipping cup 30 back into engagement with the grooves 82 on the housing 22 to secure the dipping cup 30 to the housing 22.

FIGS. 5–8 illustrate a bubble generating assembly 120 according to another embodiment of the present invention. The assembly 120 has a housing 122 that includes a handle section 124 and a bubble generating section 126. A bubble producing device 128 is provided at the bubble generating section 126, and a dipping cup 130 can be inserted over the bubble producing device 128 and secured to the housing 122.

The housing 122 can be provided in the form of two symmetrical outer shells that are connected together by, for example, screws or welding or glue. These outer shells together define a hollow interior for housing the internal components of the assembly 120, as described below.

The handle section 124 houses a power source 134 which can include at least one conventional battery. A motor 136 is electrically coupled to the power source 134 via a first wire 138. An air generator or blower 156 is coupled to a shaft 162 of the motor 136. The blower 156 is housed inside a separate blower housing 166 that is retained inside the housing 122. The blower housing 166 is connected to an opening 160 at the top 158 of the housing 122 by a funnel 168. Thus, air that is generated by the blower 156 is directed through the funnel 168 and out of the opening 160. The blower 156 can be a fan having a plurality of blades.

One end 144 of a first electrical contact 142 is connected to the power source 134. A second wire 150 couples the motor 136 to a second electrical contact 152 that is normally positioned spaced apart from the other end 146 of the first electrical contact 142. The second electrical contact 152 is attached to a switch plate 148 that extends outside the housing 122. The switch plate 148 is seated over an opening 149 in the housing 122, and is pivotably connected at one end 151 thereof to the housing 22 by a pin 153. This pivoting connection allows the switch plate 148 to be pivoted into and out of the opening 149. Thus, when the user presses on the switch plate 148, the switch plate 148 pivots into the housing 122, causing the second electrical contact 152 to contact the first electrical contact 142 to electrically couple the power source 134 and the motor 136, thereby actuating the motor 136 which in turn causes the blower 156 to rotate to generate a stream of air that is emitted through the funnel 168 and the opening 160. When the user releases the switch plate 148, a spring 147 seated between the switch plate 148 and the blower housing 166 biases the switch plate 148 outwardly away from the housing 122, to uncouple the engagement between the electrical contacts 142 and 152.

The bubble producing device 128 has at least one wand that is supported over the opening 160 so that the air generated from the blower 156 is directed at the at least one wand. In the embodiment illustrated in FIGS. 5–8, the bubble producing device 128 has one wand 164. Two shafts 170 and 172 extend from the housing 122 on either side of the opening 160 and connect to opposing sides of the wand 164. Although FIGS. 5–8 illustrate the provision of one wand 164, it is possible to provide the bubble producing device 128 with any number of wands. Each wand 164 can have the same structure, and can have the same structure as the wands 64 and 66 described hereinabove. Alternatively, the wand 164 can have a loop 12 with ridges 76 thereon, but with the cylindrical wall 16 omitted.

The housing 122 can also be provided with an opening (not shown) through which the power source 134 can be inserted and removed. A battery cover (not shown, but can be the same as element 78 above) can be provided to fit securely in the opening to cover and protect the power source 134.

The dipping cup 130 has a cup body 174 that is configured to accomplish three purposes: (1) to allow the wand 164 to be conveniently and easily fitted inside the dipping cup 130, (2) to secure the dipping cup 130 to the housing 122, and (3) to contain or hold bubble solution that can be accessed by the wand 164. As a result, the dipping cup 130 has a configuration that resembles the overall outer profile of the wand 164, and of the housing 122. In particular, the housing 122 has a shoulder 180 that extends around the housing 122 at a location adjacent to the transition between the handle section 124 and the bubble generating section 126. The shoulder 180 has a generally straight edge 184 connected to a generally semi-circular edge 186. A pair of grooves 182 are positioned adjacent the shoulder 180 on opposing sides thereof, with one groove 182 positioned adjacent the straight edge 184 and another groove 182 positioned adjacent the semi-circular edge 186. Similarly, the top edge 188 of the dipping cup 130 has a configuration that corresponds with the configuration of the shoulder 180, with a generally straight edge 190 connected to a generally semi-circular edge 192. A protrusion 194 extends inwardly from each of the straight edge 190 and the semi-circular edge 192, and is adapted to engage a corresponding groove 182 to provide a snap-fit locking engagement that secures the dipping cup 130 to the housing 122.

The provision of a generally straight edge 190 has been found to improve the attachment of the dipping cup 130 to the housing 122 because it is more difficult to disengage the protrusion 194 from a groove 182 along a straight edge. Conversely, it has been observed that the curvature of a generally semi-circular edge 192 makes it easier to disengage the protrusion 194 from a groove 182 along a curved edge. Thus, the configuration of the dipping cup 130 provides an optimal balance between ease of use (i.e., to disengage) and a secure attachment. For optimal results, the user will disengage the dipping cup 130 by first lifting the semi-circular edge 192, which provides a less secure connection of its protrusion 194 to the groove 182 along the semi-circular edge 186, and then disengaging the protrusion 194 along the generally straight edge 190.

The operation of the assembly 120 is illustrated in connection with FIGS. 5–8. First, the assembly 120 is provided in one piece with the dipping cup 130 secured to the housing 122. To use the assembly 120, the user removes the dipping cup 130 from the housing 122 according to the technique described above. The user then pours bubble solution into the dipping cup 130, and while gripping the handle section 124, extends the wand 164 into the dipping cup 130 to contact the bubble solution. The user removes the wand 164 from the dipping cup 130, and at this time, a thin film of bubble solution should extend over the opening of the wand 164. In the next step, the user presses the switch plate 148 to cause the contacts 142 and 152 to engage each other, thereby completing the electrical circuit and causing the motor 136 to be powered to rotate the blower 156 to generate bursts of air that are directed through the opening 160 and at the wand 164. The air that is blown from the blower 156 will pass through the wand 164 to produce a plurality of bubbles. The user can repeat this process to produce more bubbles. When the user has completed his or her use of the assembly 120, the user can empty the bubble solution from the dipping cup .130, and snap-fit the protrusions 194 of the dipping cup 130 back into engagement with the grooves 182 on the housing 122 to secure the dipping cup 130 to the housing. 122.

Figure 11:
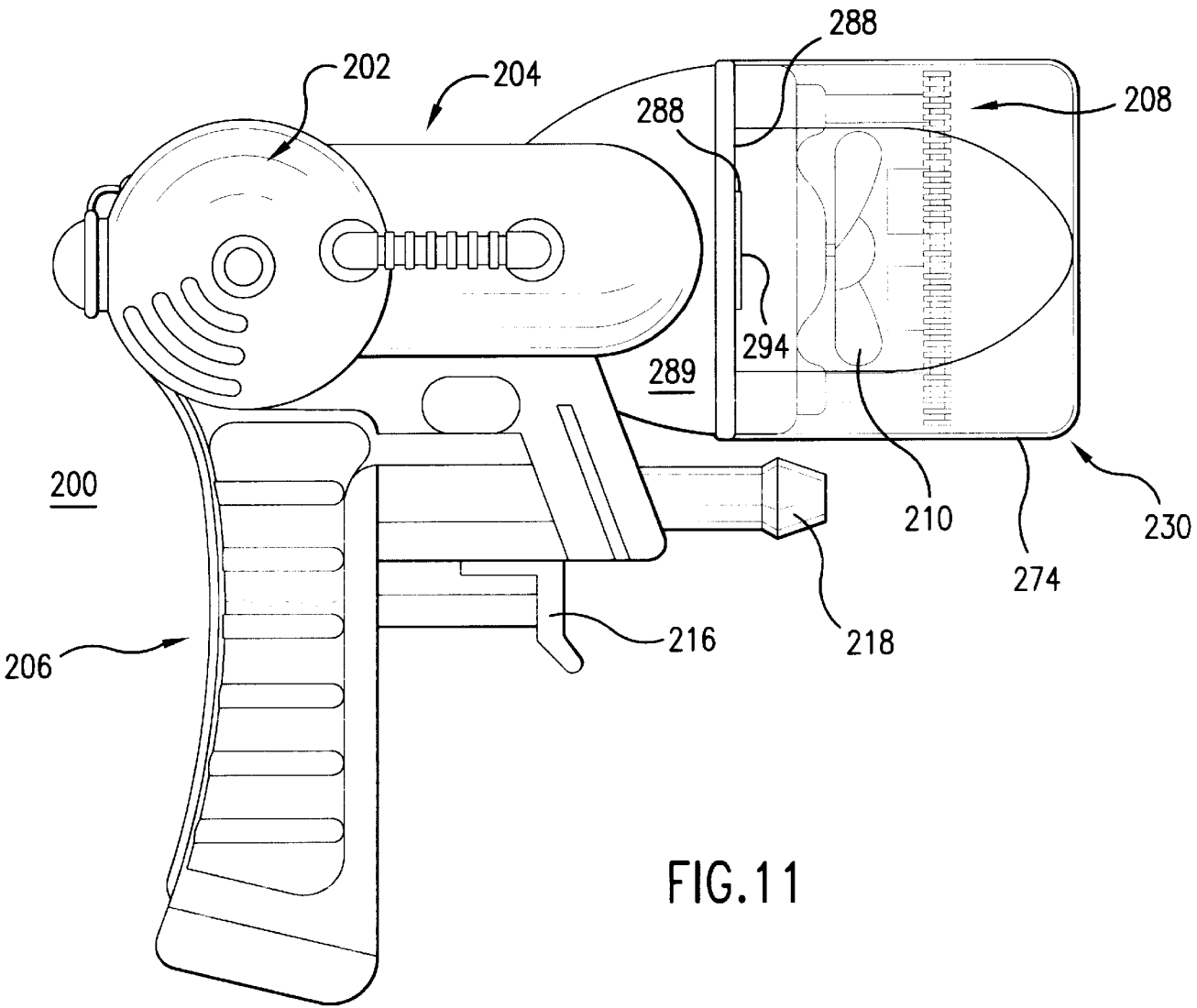
FIG. 11 is a side plan view of a bubble generating assembly according to yet another embodiment of the present invention.

FIG. 11 illustrates a bubble generating assembly 200 according to another yet embodiment of the present invention. In particular, the assembly 200 can have the same structure and configuration as the assembly 200 (except for the differences noted below) described in FIGS. 7–12 of the parent application Ser. No. 09/476,864, entitled "Bubble Generating Assemblies", filed Jan. 3, 2000, whose disclosures have been incorporated by reference. As a result, a detailed description of the assembly 200 will not be repeated herein, except to highlight the differences. The assembly 200 can also be embodied in the form of a bubble producing gun, and has a housing 202 that includes a barrel section 204 and a handle section 206. A bubble producing device 208 and an associated air generator (such as a fan) 210 are provided at the front end of the barrel section 204. The bubble producing device 208 can include a plurality of wands, which can be the same as any of the wands 64, 66 or 164 described above. A water generator is coupled to a nozzle 218 that is provided at the front end of the barrel section 204, below the wands 208. A trigger 216 is operatively coupled to the barrel section 204 and handle 206 to actuate the assembly 20. In particular, the assembly 200 can be actuated by pressing the trigger 216, which will simultaneously (1) actuate the fan 210 to generate air that will be blown at the wands 208 to produce bubbles, and (2) cause water to be ejected from the nozzle 218 to be fired at the produced bubbles. The internal components (including the water generator), and the operation, of the assembly 20 are described in greater detail in Ser. No. 09/476,864 in connection with FIGS. 7–12 thereof.

As shown in FIG. 11, a dipping cup 230 is provided to cover the wands 208. The dipping cup 230 resembles the other dipping cups 30, 130, and has a cup body 274 that is configured to accomplish three purposes: (1) to allow the wands 208 to be conveniently and easily fitted inside the dipping cup 230, (2) to secure the dipping cup 230 to the housing 202, and (3) to contain or hold bubble solution that can be accessed by the wands 208. As a result, the dipping cup 230 also has a configuration that resembles the overall outer profile of the wands 208, and of the barrel section 204 of the housing 202. For example, the top edge 288 of the dipping cup 230 has one or more protrusions 294 that extend inwardly from the top edge 288, and are adapted to engage corresponding grooves 282 provided on the outer surface 289 of the housing 202 to provide a snap-fit locking engagement that secures the dipping cup 230 to the housing 202. The dipping cup 230 can be engaged with and disengaged from the housing 202 using the same techniques described above for the other dipping cups 30 and 130.

Thus, the embodiments illustrated in FIGS. 1–8 and 11 provide dipping cups 30, 130, 230 that can be used as both a cover to protect the wands 64, 66, 164, 208 and as a dipping cup for holding bubble solution. The dipping cups 30, 130, 230 can be easily and conveniently secured to the housing 22, 122, 202 so that they can be carried with the assembly 20, 120, 200 for use at any physical location while minimizing the possibility of losing the dipping cup 30, 130, 230.

While the description above refers to particular embodiments of the present invention, it will be understood that many modifications may be made without departing from the spirit thereof. The accompanying claims are intended to cover such modifications as would fall within the true scope and spirit of the present invention. As a non-limiting example, the power source 34, 134 can be omitted and mechanical means provided for actuating the blower 156 or air generator 56.

What is claimed is:

1. A bubble generating assembly, comprising:

a housing;

an air generator associated with the housing;

a bubble producing device positioned in front of the air generator to receive air generated from the air generator; and a cover having the shape of an inverted cup, the cover having an interior and an upper peripheral edge that defines an opening to the interior;

a locking mechanism that removably connects the cover to the housing, with the upper peripheral edge of the cover contacting the housing and the cover retaining the bubble producing device in the interior when the cover is connected to the housing;

wherein the bubble producing device comprises a wand having an opening provided therein, the wand having an upper surface and a lower surface, with a plurality of ridges provided on the upper surface and the lower surface; and wherein the wand further includes a cylindrical wall extending from the opening of the wand and having an inner circumferential surface, with a plurality of ridges provided on the inner circumferential surface of the cylindrical wall.

2. The assembly of claim 1, wherein the cover has a top edge, and wherein the locking mechanism is a protrusion provided along the top edge of the cover.

3. The assembly of claim 2, wherein the top edge has two opposing curved narrow sides and two opposing curved widened sides.

4. The assembly of claim 2, wherein the top edge has a straight edge connected to a semi-circular edge.

5. The assembly of claim 2, wherein the housing has an outer surface with a groove provided thereon for receiving the protrusion.

6. The assembly of claim 1, wherein the bubble producing device has a plurality of loops, each of said loops defining an interior opening.

7. The assembly of claim 1, wherein the housing has a switch, and a power source operatively coupled to the air generator and the switch.

8. The assembly of claim 1, wherein the air generator is positioned inside the housing.

9. The assembly of claim 1, wherein the air generator is positioned outside the housing between the housing and the bubble producing device.

10. A bubble generating assembly, comprising:

a housing;

an air generator associated with the housing;

a bubble producing device positioned in front of the air generator to receive air generated from the air generator, the bubble producing device including a wand having an opening provided therein, the wand having an upper surface and a lower surface, with a plurality of ridges provided on the upper surface and the lower surface; and a cover having an interior and a locking mechanism that removably connects the housing, and the cover retaining the bubble producing device in the interior when the cover is connected to the housing;

wherein the wand further includes a cylindrical wall extending from the opening of the wand and having an inner circumferential surface, with a plurality of ridges provided on the inner circumferential surface of the cylindrical wall; and wherein the plurality of ridges provided on the inner circumferential surface of the cylindrical wall includes a first layer of ridges and a second layer of ridges, with the second layer of ridges having a height that is greater than the height of the first layer of ridges.

11. A bubble generating assembly, comprising:

a housing;

an air generator associated with the housing;

bubble producing device positioned in front of the air generator to receive air generated from the air generator; and a dipping cup having an interior and an upper peripheral edge that defines an opening to the interior;

a locking mechanism that removably connects the dipping cup to the housing, with the upper peripheral edge of the dipping cup contacting the housing and the dipping cup retaining the bubble producing device in the interior when the dipping cup is connected to the housing;

wherein the bubble producing device comprises a wand having an opening provided therein, the wand having an upper surface and a lower surface, with a plurality of ridges provided on the upper surface and the lower surface;

wherein the wand further includes a cylindrical wall extending from the opening of the wand and having an inner circumferential surface, with a plurality of ridges provided on the inner circumferential surface of the cylindrical wall; and wherein the plurality of ridges provided on the inner circumferential surface of the cylindrical wall includes a first layer of ridges and a second layer of ridges, with the second layer of ridges having a height that is greater than the height of the first layer of ridges.

12. The assembly of claim 11, wherein the dipping cup has a top edge, and wherein the locking mechanism is a protrusion provided along the top edge of the dipping cup.

13. The assembly of claim 12, wherein the top edge has two opposing curved narrow sides and two opposing curved widened sides.

14. The assembly of claim 12, wherein the top edge has a straight edge connected to a semi-circular edge.

15. The assembly of claim 12, wherein the housing has an outer surface with a groove provided thereon for receiving the protrusion.

16. The assembly of claim 11, wherein the bubble producing device has a plurality of loops, each of said loops defining an interior opening.

17. The assembly of claim 11, wherein the housing has a switch, and a power source operatively coupled to the air generator and the switch.

18. The assembly of claim 11, wherein the air generator is positioned inside the housing.

19. A bubble generating assembly, comprising:

a housing;

an air generator associated with the housing;

a bubble producing device positioned in front of the air generator to receive air generated from the air generator; and a dipping cup having an interior and a locking mechanism that removably connects the housing, and the dipping cup retaining the bubble producing device in the interior when the dipping cup is connected to the housing;

wherein the air generator is positioned outside the housing between the housing and the bubble producing device.

* * * * *